United States Patent [19]

Kirjavainen

[11] 4,406,741

[45] Sep. 27, 1983

[54] ADJUSTABLE HEADBOX FOR A PAPER MACHINE

[75] Inventor: Alvi Kirjavainen, Jyväskylä, Finland

[73] Assignee: Valmet Oy, Finland

[21] Appl. No.: 328,792

[22] Filed: Dec. 8, 1981

[30] Foreign Application Priority Data

Dec. 17, 1980 [FI] Finland ..... 803946

[51] Int. Cl.[3] ..... D21F 1/02; D21F 1/06

[52] U.S. Cl. ..... 162/336; 162/337; 162/339; 162/340; 162/343

[58] Field of Search ..... 162/336, 337, 339, 340, 162/343

[56] References Cited

U.S. PATENT DOCUMENTS

| | | | |
|---|---|---|---|
| 4,162,189 | 7/1979 | Kirjavainen | 162/343 |
| 4,166,759 | 9/1979 | Kirjavainen | 162/340 |
| 4,202,724 | 5/1980 | Kirjavainen | 162/336 |
| 4,225,386 | 9/1980 | Edblom et al. | 162/343 |

*Primary Examiner*—Peter Chin

*Attorney, Agent, or Firm*—Steinberg & Raskin

[57] ABSTRACT

A paper machine has an equalizing part between a distribution pipe system part and a turbulence section in the flow path of the pulp stock. The equalizing part has an equalizing chamber with a length in the direction of flow of the pulp stock and a front wall. An adjusting device is coupled to the front wall of the equalizing chamber for adjusting the length of the equalizing chamber by adjustment of the position of the front wall.

8 Claims, 5 Drawing Figures

ADJUSTABLE HEADBOX FOR A PAPER MACHINE

BACKGROUND OF THE INVENTION

The present invention relates to an adjustable headbox for a paper machine. More particularly, the invention relates to an adjustable headbox for a paper machine having a distribution header part, a distribution pipe system part connected to the distribution header part in the flow path of the pulp stock, an equalizing part communicating with an air tank, a turbulence part following the equalizing part, and a lip cone part, or the equivalent, after the turbulence part.

Finnish Pat. No. 50260, which is the equivalent of U.S. Pat. No. 3,791,918, of the present inventor, discloses a headbox having a distribution pipe part after the distribution header. An intermediate chamber part follows the distribution pipe part and is followed by a lamellar part. A lip cone part is provided after the lamellar part. The lamellar part consists of a plurality of lamellae inclined relative to the vertical plane and located side by side, defining between each other turbulence passages having a trapezoidal cross-section.

The operation of the headbox disclosed in the aforedescribed Finnish patent has proven favorable in certain respects, but one of its drawbacks is its fixed construction. It is therefore impossible to change substantially the brand or quality of paper produced, or to achieve a fine adjustment of the headbox properties to conform exactly to the paper brand being produced, to the pulp stock quality, or to the machine speed, in paper machines having this headbox.

Earlier Finnish patent application Nos. 800018 and 801167, of the present inventor, disclose certain headbox designs with a cassette structure. These headbox designs represent a specific endeavor to use exchangeable cassette-like components for the pulp stock flow passage-confining components of the headbox, so that the headbox may be assembled of exchangeable components. It is thereby comparatively easy to alter the structure of the headbox when the product quality is changed. A construction of this type also renders the maintenance operations for the headbox and its cleaning easier than ever before.

The operation of the headbox equalizing chamber at the extremes of the optimum range presents problems regarding the maintaining of cleanliness and paper formation, since the flow region, having constant dimensions, cannot be adjusted in accordance with speed, pulp stock qualities, or use of fillers and chemical additions. The adjustable headbox of the present invention eliminates, or reduces to a satisfactory level, the drawbacks of the known headboxes.

The adjustable headbox of the present invention is also applicable to multi-ply headboxes. Thus, Finnish patent application No. 801587 of the present inventor discloses a multi-ply headbox for a paper machine, having two or more pulp suspension flow passages on top of each other. These pulp suspension flow passages come together in the region of the lip cone and comprise a distribution header part, a distribution pipe system part or the equivalent, and flow equalizing and turbulence parts. The novel aspect of this Finnish patent application is that a sturdy plate component provided with sets of flow apertures is provided between the flow equalizing part and the turbulence part. The turbulence part consists of a plurality of parallel plate lamellae or the equivalent, fixed to be stationary primarily by their front ends in connection with the plate component only. One or a plurality of intermediate plates, extending into the region of the lip part of the headbox, are provided between the sets of plate lamellae.

SUMMARY OF THE INVENTION

The principal object of the invention is to provide a headbox for a paper machine, which headbox preserves all the good functional properties of the headbox disclosed in Finnish Pat. No. 50260, or an equivalent headbox.

An object of the invention is to provide an adjustable headbox for a paper machine, which headbox is superior to earlier headboxes due to its adjustability and keeps clean better than headboxes of the prior art.

Another object of the invention is to provide a headbox for a paper machine, which headbox has an equalizing chamber of adjustable length and thereby overcomes the many disadvantages of an equalizing chamber of excessive length.

Still another object of the invention is to provide a headbox for a paper machine, which headbox may have the length of its equalizing chamber adjusted while the machine is running, thereby avoiding the need for costly shutdowns.

Yet another object of the invention is to provide a headbox for a paper machine, which headbox is adjustable and thereby enables variation of the brand or quality of paper produced, fine adjustment of the properties of the headbox to conform exactly to the paper brand being produced, to the pulp stock quality, or to the machine speed.

In order to achieve these objects, and others which will become apparent, the headbox of the invention comprises an equalizing part having an equalizing chamber with a length in the direction of flow of the pulp stock and a front wall. The front wall of the equalizing chamber is adjustable in position in the equalizing chamber to adjust the length of the equalizing chamber.

In the headbox of the invention, the location of the distribution pipe system is adjustable in the direction of flow of the pulp stock, whereby the length, in the intermediate chamber region, of the turbulence coming from said distribution pipe system may be adjusted to the best possible level in view of the self-cleaning tendency of the grating, or equivalent turbulence section, and, in each instance, in conformity with the factors influencing the paper brand and the operation.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
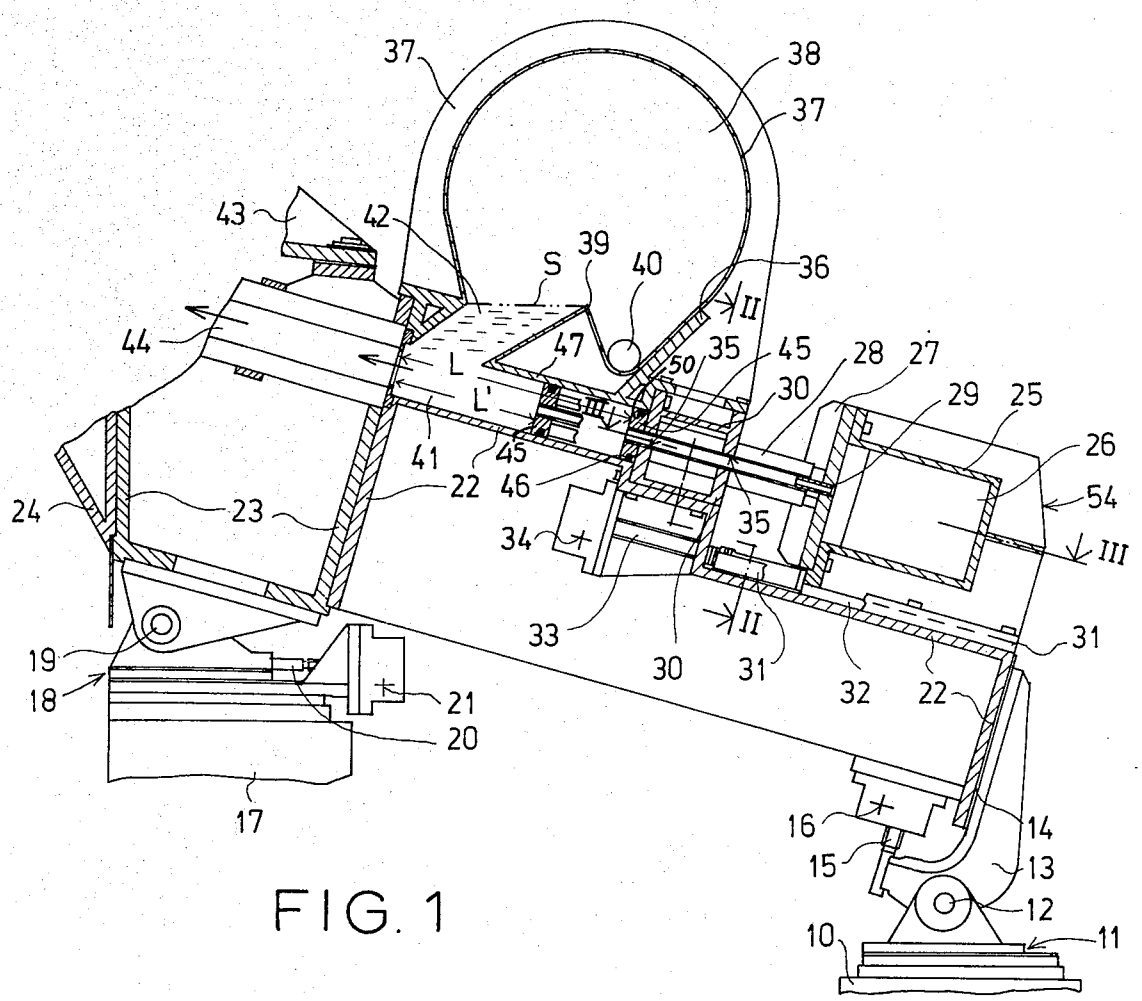
FIG. 1 is a view, partly in vertical and machine direction section, of an embodiment of the headbox of the invention, and taken along the lines I—I, of FIG. 3.
Figure 5:
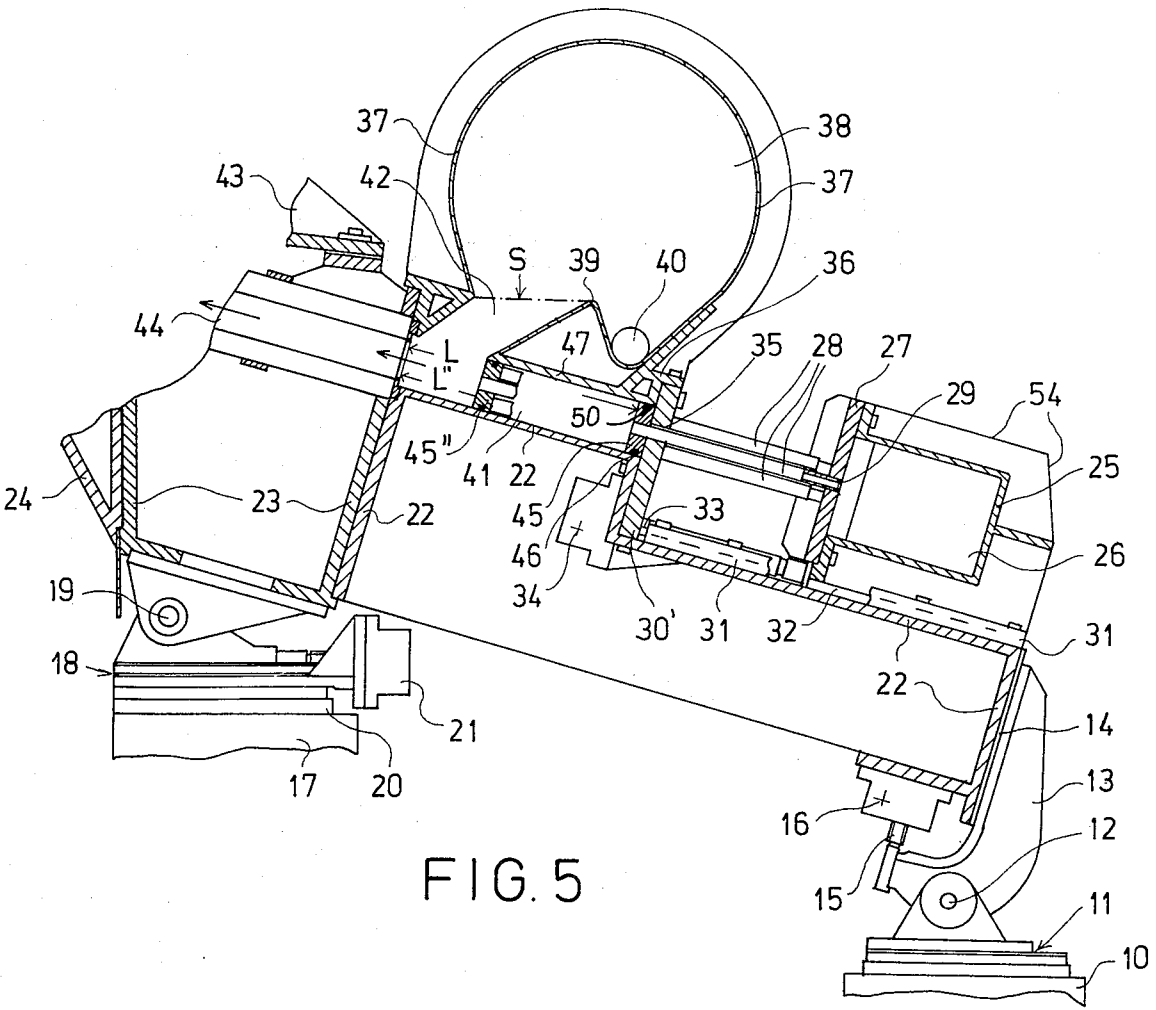
FIG. 5 is a view, partly in vertical and machine direction section, of another embodiment of the headbox of the invention.

As shown in FIGS. 1 and 5, the headbox is supported by pedestal structures 10 and 17. First slide guides 11 are provided with the pedestal structure 10. The pedestal structure 10 rests on the first slide guide 11 by mediation of pivot axles 12. Similarly, slide guides 18 are provided with the other pedestal structure 17 and support to the front end of the headbox over pivot axles 19. Supporting lugs 13 are affixed to the rear pivot axles 12. A worm gear mechanism 16 is provided in conjunction with the end of one of the rear pivot axles 12. The worm gear mechanism 16 has displacement rods 15 affixed to the supporting lugs 13. The worm gear unit 16 is used to displace the rear end of the headbox in substantially vertical slide guides 14, provided in association with the supporting lugs 13. A worm gear mechanism 21 is provided with the front end pedestal structure 17 for horizontal adjustment of the headbox. The worm gear mechanism 21 has displacement rods 20 coupled to the headbox for moving said headbox horizontally. The headbox will then slide in the slide guides 11 and 18 provided on the pedestal structures 10 and 17. The described displacing structures are known in themselves in the art and are only described in this connection as an example and to provide background for the invention.

The substructure of the headbox consists of a frame structure 22 having a front part connected to a box-type beam 23 of the turbulence part. The beam 23 is in turn connected at its front part with a lower lip beam 24, only partly shown in FIGS. 1 and 5.

Figure 3:
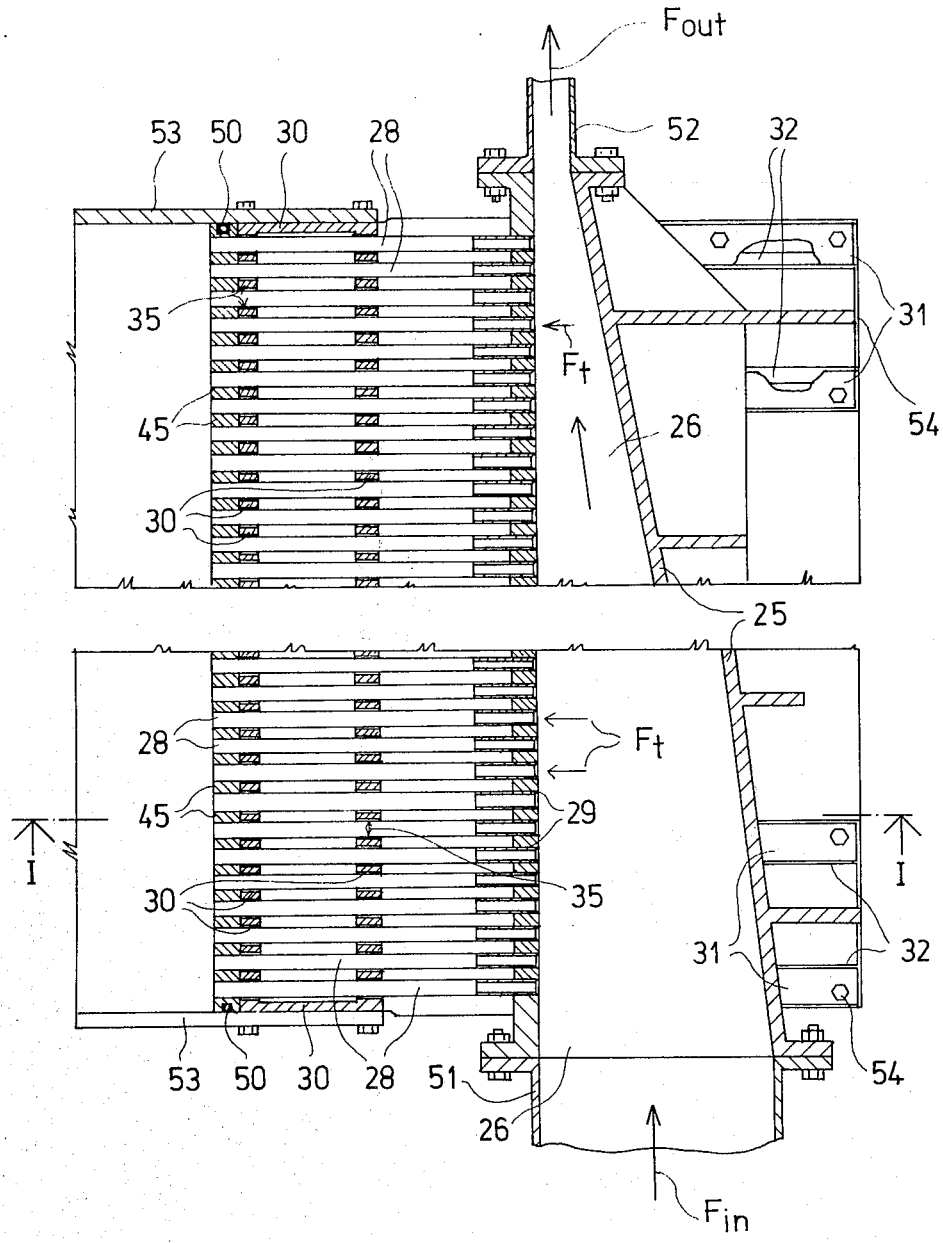
FIG. 3 is a sectional view, taken along the lines III—III, of FIG. 1.

The headbox includes a distribution header 25, confining within itself a flow volume 26 tapering down in the direction of flow of the pulp stock, $F_{in}$-$F_{out}$ (FIG. 3). In FIG. 3, the distribution header 25 includes a pulp stock inlet pipe 51 and a bypass pipe 52. The flow $F_{in}$-$F_{out}$ from the distribution header 25 divides into flows $F_t$, in the machine direction, into a system of distribution pipes 28. The distribution pipe system 28 is of special design in order to achieve the objects of the invention, and is hereinafter described in greater detail.

An equalizing chamber 41 follows the distribution pipe system 28 and borders the planar wall portion of the headbox substructure frame 22 and a top wall 47, these walls being parallel. The equalizing chamber 41 communicates with an air tank 37 via a passage 42. The air tank 37 encloses an air volume 38 and functions to attenuate pressure fluctuations occurring in the pulp stock. The pulp stock has a free surface S in immediate contact with the air volume 38. The air tank 37 contains, as known in itself in the art, a weir 39 with an overflow pipe 40 beneath it. The weir 39 determines the level S of the pulp stock. Regulation of the pressure of the air volume 38 simultaneously regulates the pressure at which the pulp stock discharges from the lip slit onto the wire, or equivalent (not shown in the FIGS. ).

A turbulence section 44 follows the equalizing chamber 41. The turbulence section 44 consists, for example, of a lamellated component like that disclosed in Finnish Pat. No. 50260. Naturally, other kinds of lamellar sections may be used such as, for example, the type disclosed in Finnish patent application No. 801854 of Alvi Kirjavainen. A lip cone section known in itself in the art (not shown in the FIGS.) follows the turbulence section 44. The lip cone section is preferably adjustable. The pulp stock flows through the lip cone section onto the forming wire (not shown in the FIGS.). A part 43 of the upper lip structure of the headbox is shown in FIGS. 1 and 5.

The novel structural features of the invention are hereinafter described in greater detail.

The distribution header 25, the distribution pipe system 28 integrally connected therewith and the front wall 45 of the equalizing chamber 41, which ties the front ends of said distribution pipes together, are movable in the machine direction. To accomplish this, the distribution header 25, with its supporting plate 54, is mounted on the planar rear portion of the lower frame 22 via slide guides 31 and 32. The distribution header 25, 26, 27, 54 is linked to displacement rods 33 of worm gears 34. There are two or more worm gears 34 in parallel, in the cross-machine direction of the headbox, arranged to operate in synchronism to move the distribution header 26, the distribution pipe system 28, and the components thereto connected, in the machine direction in order to achieve the objects of the invention.

Figure 2:
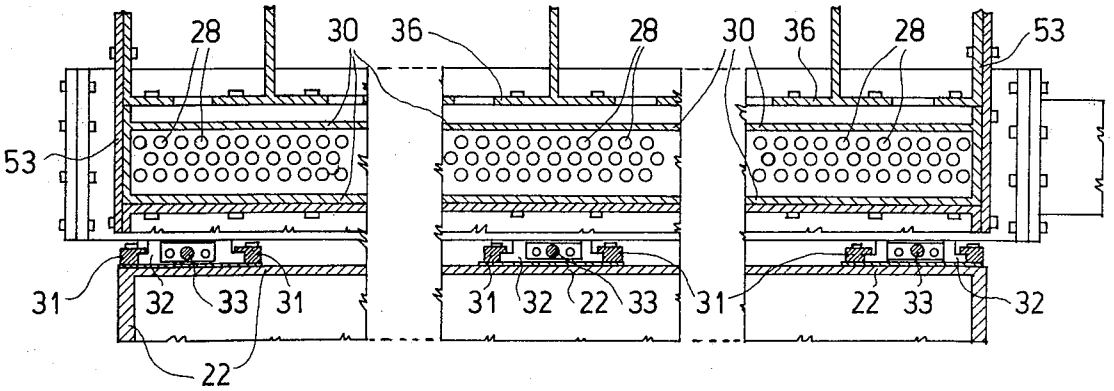
FIG. 2 is a cross-sectional view, taken along the lines II—II, of FIG. 1.

As shown in FIGS. 1, 2 and 3, the system of distribution pipes of system 28 is movable through the box component 30. The box component 30 is positioned between the lower frame structure 22 and upper frame structures 36 and 47, connected to the air tank 37, and functions as an intermediate section, binding such forces as occur. The front and rear walls of the box component 30 are provided with holes 35 consistent with the system of distribution pipes 28. The rear ends of the distribution pipes of system 28 are mutually connected via the front wall 45 of the equalizing chamber 41. In addition, reducing components 29 are provided at the front ends of the pipes 28. The worm gears 34 are operated to move the distribution header 25, in order to regulate the effective length L of the equalizing chamber 41, particularly in the direction of flow of the pulp stock. This causes the set of distribution pipes 28 to slide, along with the front wall 45, in the holes of the box component 30.

The changed location 45' of the front wall 45 of the equalizing chamber 41 is indicated by interrupted lines in FIG. 1. In the changed location 45' of the front wall 45, the effective length of the equalizing chamber 41 is reduced from the maximum length L to L'.

In the embodiment of FIG. 5, a plate component 30' is used instead of the box component 30. The plate component 30' binds the forces between the lower frame structure 22 and the upper frame structure 36, 47, 37. FIG. 5 shows the extreme forward-adjusted position 45'' of the front wall 45 of the equalizing chamber 41, which wall then lies adjacent the rear wall of the passage 42 leading to the air tank 37. In this case, the equalizing chamber 41 has a length L'', which is a minimum. The embodiment of FIG. 5 is favorable for implementing the longest possible adjustment range, L-L'', of the length of the equalizing chamber 41.

The front wall 45 of the equalizing chamber 41 absorbs forces acting between the walls 22 and 47 and simultaneously seals itself with sufficient accuracy against the smooth walls 22 and 47, via its abutting surfaces. Sealing elements 46 and 50 are required, in addition to the front wall 45, to achieve an adequate seal. The pipes of the distribution pipe system 28 move in the holes 35 of the box component 30, or the plate component 30', with a free sliding fit, or even with greater play.

Figure 4:
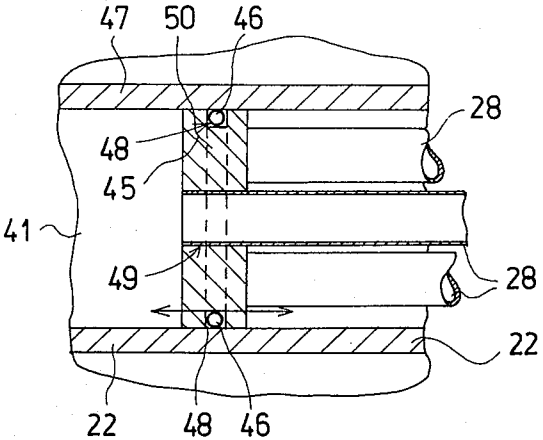
FIG. 4 is a detailed view, on an enlarged scale, of the front wall 45 of FIG. 1.

FIG. 4 shows the front wall 45 of the equalizing chamber 41 on a larger scale. The distribution pipes 28 are connected by a suitable connection 49 to the front wall 45. The front wall 45 is encircled by a groove 48, which accommodates a tubular, or O-ring, packing 46, which also extends in the form of a vertical part 50 in contiguity with side walls 53 of the headbox.

The main principle of the adjustment of the length L of the equalizing chamber 41 is that the higher the production speed of the paper machine, and, simultaneously, the flow velocity of said equalizing chamber, the greater is the length L of said equalizing chamber which it is proper to use. In headbox structures of the prior art, it has been necessary to dimension the length of the equalizing chamber 41 to suit the maximum production rate or flow velocity.

The factors influencing the length L of the equalizing chamber 41 include the pulp stock viscosity, the flow velocity, the type and quantity of chemicals used in the pulp stock, and the pulp stock quality, on the whole. Of these factors, the pulp stock flow velocity and the viscosity of the pulp stock are those exerting the greatest influence on the length L selected for the equalizing chamber 41.

As will be understood from the foregoing, it has previously been essentially unavoidable that a paper machine is run with an equalizing chamber of excessive length, with the consequence that the turbulence of the flow has been allayed too soon in the equalizing chamber. This, in turn, results in flocs in the paper and accumulation of fiber bundles at points of discontinuity. The phenomenon of accumulation of fiber bundles, again, introduces soiling problems. The flow should still have a certain, sufficiently high, turbulence level at the stage at which the pulp stock meets the turbulence section 44. Such stage is, for example, a grating or lamellated section.

An important advantage of the invention is that the length of the equalizing chamber 41 may be adjusted on a running paper machine, thereby avoiding the necessity for costly production shut-downs, if such adjustment has to be made.

Obviously, when the adjustable system of distribution pipes 28 of the invention and the distribution header 26 are regulated, the distribution header inlet pipe 51 must be connected to a flexible connector, or other equivalent member, to permit the changes of location of said distribution header.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a paper machine, a headbox comprising:

distribution header means;

a system of distribution pipes having an upstream end communicating with said distribution header means and a downstream end;

an equalizing chamber having an effective length in the direction of pulp flow including a downstream end and an upstream end constituted by movable front wall means having flow passage means formed there through communicating with said downstream end of said distribution pipe system;

means for adjusting the position of said front wall means of said equalizing chamber to adjust the effective length of said equalizing chamber;

a turbulence section having an upstream end communicating with said downstream end of said equalizing chamber;

and lip means following said turbulence section for delivering pulp flow to a forming wire.

2. The combination of claim 1, wherein said system of distribution pipes include a plurality of distribution pipes having upstream and downstream ends and wherein said movable front wall means having said flow passage means formed there through being constituted by an apertured front wall and wherein said downstream ends of said distribution pipes are integrally connected to said front wall of said equalizing chamber to communicate with the apertures formed therein.

3. The combination of claim 2, wherein said upstream end of said system of distribution pipes is integrally connected to the distribution header of the headbox, and further comprising a headbox supporting substructure, slide guide means mounted on said headbox supporting substructure, mounting means for slidably mounting said distribution header on said slide guide means, and coupling means for coupling said distribution header to said means for adjusting the position of said front wall means of said equalizing chamber, whereby said distribution header, said distribution pipe system and said front wall of said equalizing chamber are adjustably positioned.

4. The combination of claim 2, wherein said headbox includes a lower frame structure and an upper frame structure, and further comprising a force-binding structure situated between said lower and upper frame structures, said force-binding structure comprising an elongate member having a box-like cross-section having walls and a plurality of holes formed through said walls, said system of distribution pipes having pipes slidably passing through said holes of said force-binding structure.

5. The combination of claim 2, wherein said headbox includes a lower frame structure and an upper frame structure, and further comprising a plate situated between said lower and upper frame structures of said headbox, said plate having a plurality of holes formed therethrough, said system of distribution pipes having pipes slidably passing through said holes of said plate.

6. The combination of claim 1, wherein said position adjusting means comprises a worm gear mechanism.

7. The combination of claim 1, whereins said equalizing chamber has an inner surface and said front wall means of said equalizing chamber has an outer surface contiguous with said inner surface of said equalizing chamber, and further comprising sealing means provided on said outer surface of said front wall means sealingly engaging said inner surface of said equalizing chamber.

8. The combination of claim 1, wherein said headbox further includes an air tank communicating with said equalizing chamber through a passage at least partly defined by a passage wall, and wherein said front wall means of said equalizing chamber has a range of adjustment which extends substantially to said wall of said passage when the effective length of said equalizing chamber is at a minimum.

* * * * *